US005082631A

United States Patent [19]

Lenmark, Sr. et al.

[11] Patent Number: 5,082,631

[45] Date of Patent: Jan. 21, 1992

[54] TRANSPORT TRAY WITH PIVOTAL CIRCULAR CAM RAMP FOR BIOLOGICAL SAMPLES

[75] Inventors: Voigt O. Lenmark, Sr., St. Louis Park; William A. Koentopp, St. Paul, both of Minn.

[73] Assignee: Transpan Company, Minneapolis, Minn.

[21] Appl. No.: 534,722

[22] Filed: Jun. 7, 1990

[51] Int. Cl.[5] ..... B01L 3/00

[52] U.S. Cl. ..... 422/102; 422/104; 220/94 R; 220/377; 220/331

[58] Field of Search ..... 422/102, 104; 206/587, 206/523; 220/331, 329, 628, 211

[56] References Cited

U.S. PATENT DOCUMENTS

| | | | |
|---|---|---|---|
| 2,430,222 | 11/1947 | Goldbert | 220/36 |
| 2,880,865 | 4/1959 | Knox | 206/72 |
| 3,643,812 | 2/1972 | Mander et al. | 211/74 |
| 4,319,683 | 3/1982 | Correa, III | 206/349 |
| 4,434,890 | 3/1984 | Sieck et al. | 206/443 |
| 4,501,360 | 2/1985 | Levy et al. | 206/443 |
| 4,550,828 | 11/1985 | Baldwin et al. | 206/349 |
| 4,720,021 | 1/1988 | Byrns | 220/94 |
| 4,826,003 | 5/1989 | Levy | 206/45.31 |
| 4,863,023 | 9/1989 | Payne et al. | 206/523 |

FOREIGN PATENT DOCUMENTS

| | | |
|---|---|---|
| 678458 | 12/1964 | Italy . |
| 405352 | 2/1934 | United Kingdom . |

*Primary Examiner*—Robert J. Warden
*Assistant Examiner*—Laura E. Collins
*Attorney, Agent, or Firm*—Kinney & Lange

[57] ABSTRACT

A biological vial transport tray is provided comprising an open top tray portion having a base wall, a plurality of end walls and a plurality of side walls. The base wall includes a bottom surface and a top surface. The end walls and the side walls form a rim around the tray portion. A pedestal extends from the bottom surface of the base wall for supporting the tray portion. In addition, a center handle having a grip member is provided. A pair of cover lids surround the rim and cover the tray portion when the cover lids are in a closed position. Each cover lid has a pair of end cover walls, a top cover wall, a side cover wall and a plurality of arms on the respective end cover walls. Each arm extends downwardly from the end cover walls to position over the end walls of the tray portion. The arms have pins that ride in cam guide slots recessed into the end walls of the tray portion for pivotally and slidably mounting the cover lids on the tray portion so the cover lids are guided as they are moved between the open and closed positions.

17 Claims, 4 Drawing Sheets

TRANSPORT TRAY WITH PIVOTAL CIRCULAR CAM RAMP FOR BIOLOGICAL SAMPLES

BACKGROUND OF THE INVENTION

The present invention relates to trays for medical or laboratory use, and in particular, it relates to compartmented trays, each having a cover and a handle, for carrying vials for biological samples.

The use of trays for medical and laboratory use, for the purpose of carrying vials of such items as blood and urine, is well known. For instance, the Great Britain Patent No. 2,173,174 describes a package for vials comprising a block of shock absorbent material with a plurality of bores extending therethrough. A separate piece of shock absorbent material is placed at the bottom of the bores with a yet another separate piece of shock absorbent material placed across the bores. A sleeve holds the block and the absorbent material pieces in position.

Another example of a biological sample vial tray is described in the pending application entitled "Biological Sample Vial Transport Tray", Ser. No. 534,444 now U.S. Pat. No. 4,997,090 by the same inventors as the present application.

SUMMARY OF THE INVENTION

A biological vial transport tray is provided comprising a tray portion having a base wall, a plurality of end walls and a plurality of side walls. The base wall includes a bottom surface and a top surface. The end walls and the side walls form a rim around the tray portion.

An offset foot or pedestal projects from the bottom surface of the base wall. The offset foot preferably includes a leg having a first end and a second end. The first end is attached to the bottom surface of the base wall and projects from the base wall. A pair of laterally extending support feet extend from the second end of the leg.

In addition, a center handle having a grip member is also provided. The center handle projects from the top surface of the base wall past the rim and in the direction opposite the leg. Preferably, the tray portion and the center handle are integrally molded together.

A pair of hollow cover lids rest on the rim of the tray portion when the cover lids are in a closed position. Preferably, the cover lids are constructed of a transparent material. Each cover lid has a pair of end cover walls, a top cover wall, a side cover wall and a pair of arms which extend downwardly from the respective end cover walls past the rim.

Preferably, each cover lid includes a cover handle connected to the top cover. Each cover handle is preferably integral to the top cover and extends the entire length of the tray. When the cover lid is in a closed position, the cover handle mates with the center handle.

A ramping mechanism for pivoting each of the cover lids from the closed position to a position off the rim of the hollow tray portion is provided. The ramping mechanism is formed at the end walls of the tray portion to connect each arm of the respective cover lids to the associated end walls. Preferably, the ramping mechanism comprises a recessed guide cam slot formed in the tray portion end walls.

A guide follower connected to each arm follows the guide cam slot to pivot the respective cover lid off the rim to an open position. The guide follower rests in the recessed cam slot when the cover lid is in the closed position.

In the preferred embodiment, the top cover wall pivots to a position such that the top cover wall rests against the side wall. In addition, the side cover wall pivots to a position such that the side cover wall is positioned between the bottom surface of the base wall and the pedestal.

Preferably, a retainer is positioned within the tray portion such that the retainer rests upon the top surface of the base wall and between the end walls and the side walls. The retainer comprises a block of shock absorbent material having at least one hole extending therethrough.

DETAILED DESCRIPTION OF THE PREFERRED EMBODIMENTS

Figure 1:
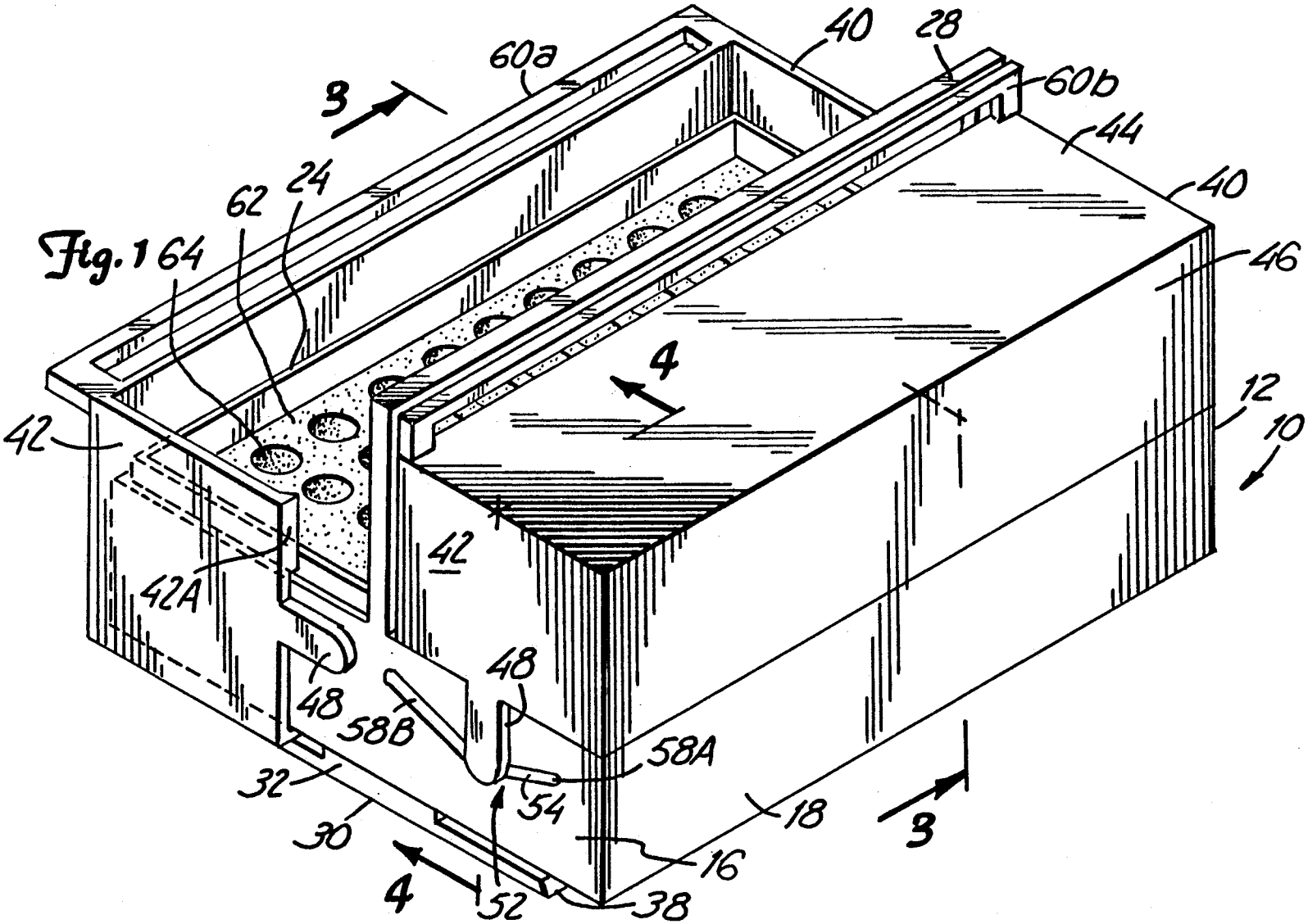
FIG. 1 is a perspective view of the biological sample vial transport tray of the present invention.
Figure 2:
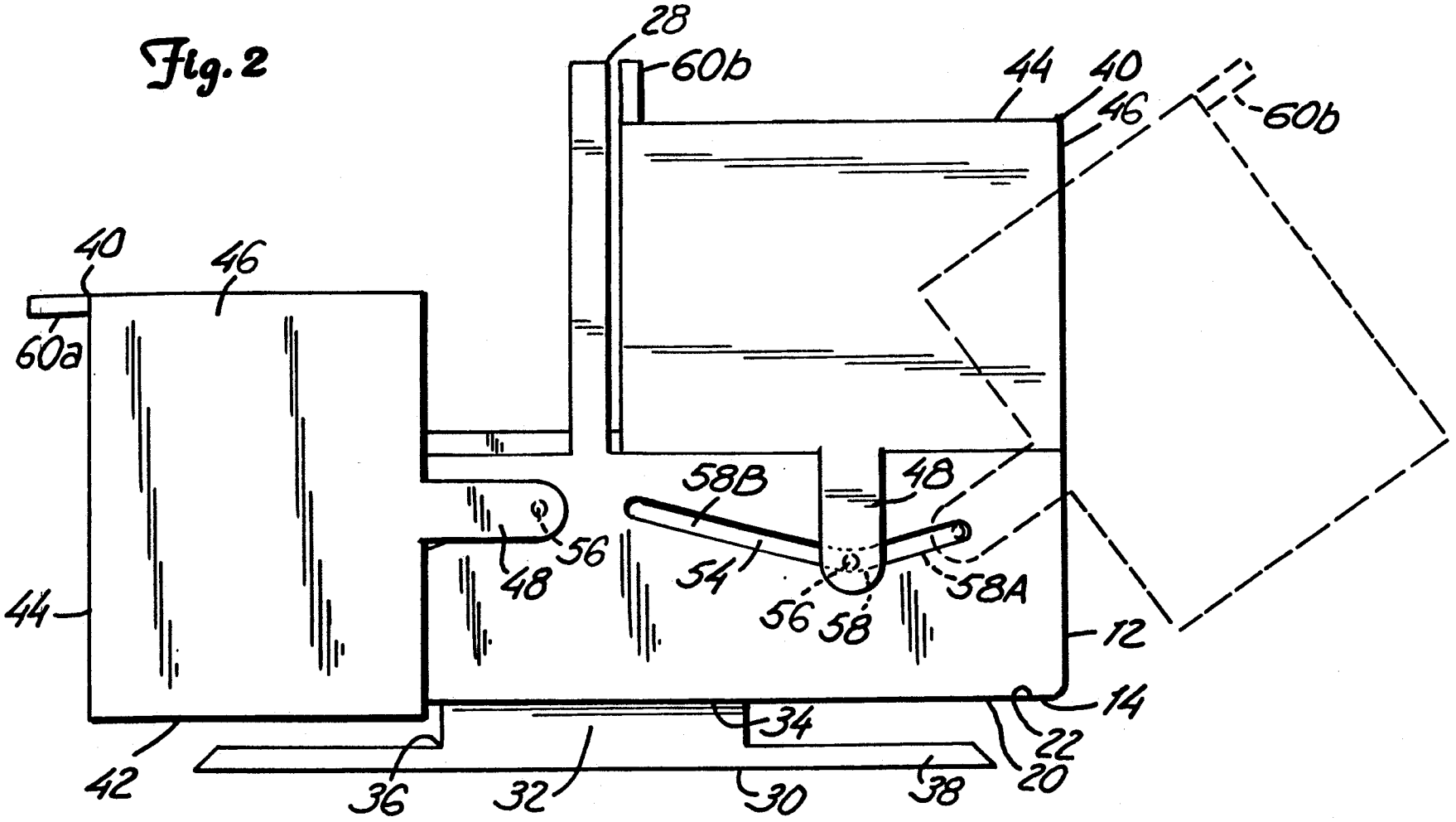
FIG. 2 is a side view of the biological sample vial transport tray of the present invention with one cover open and the other closed, and with one of the covers in phantom after being pivoted partly off the rim.
Figure 3:
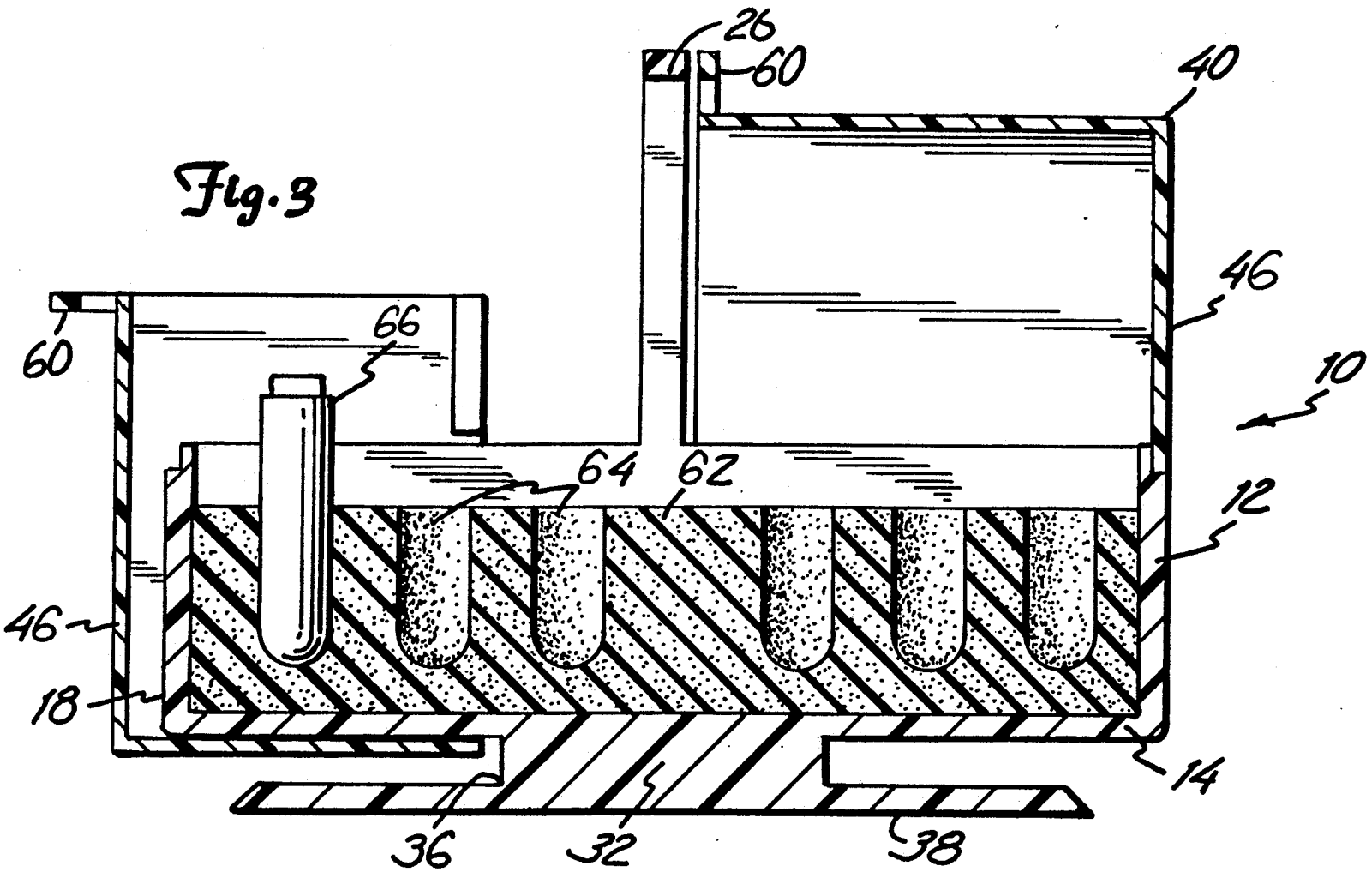
FIG. 3 is an sectional view of the biological sample vial transport tray taken along line 3—3 of FIG. 1.
Figure 4:
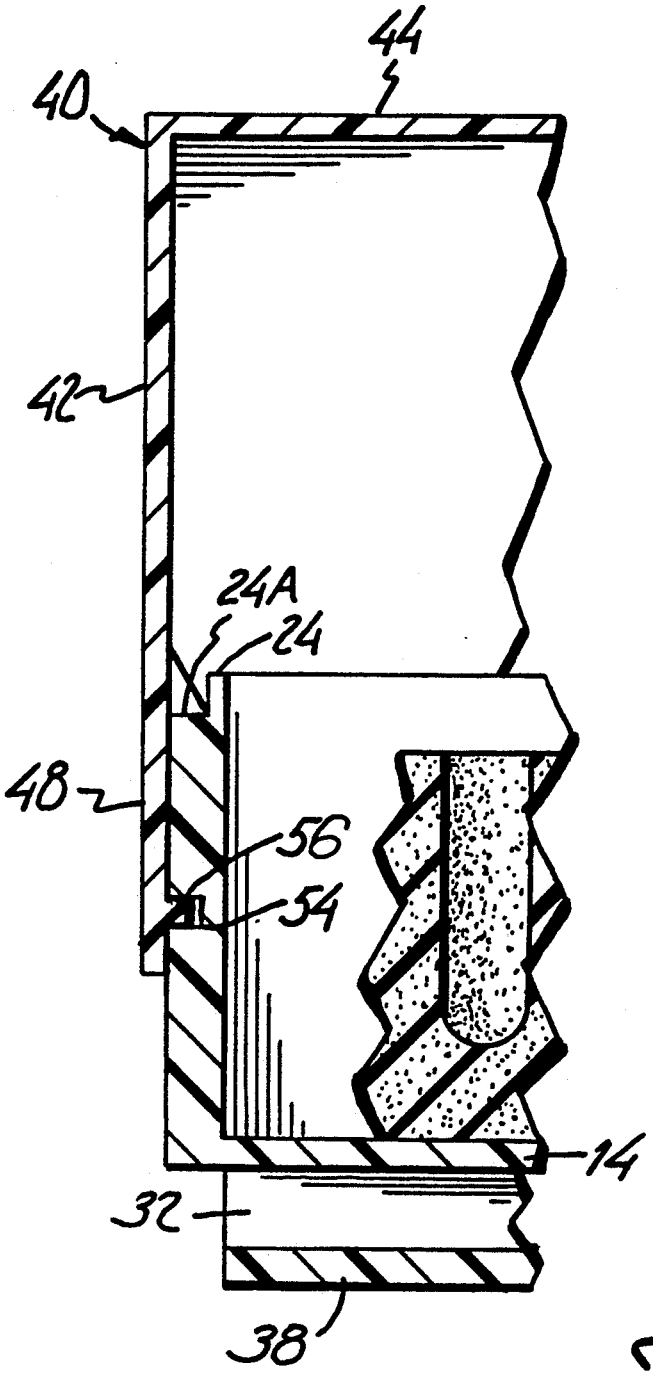
FIG. 4 is a sectional view of the biological sample vial transport tray taken along line 4—4 of FIG. 1.

A covered biological sample transport tray of the present invention, with a pivotal circular cam ramp for guiding the cover movement, is generally indicated at 10 in FIGS. 1, 2 and 3. The tray 10 includes a hollow tray portion 12 having a base wall 14, a plurality of end walls 16, and a plurality of side walls 18.

The base wall 14 has a bottom surface 20 and a top surface 22. The tray portion 12 is molded from a plastic material such that the side walls 18 and the end walls 16 are integral with the base wall 14 and integral with each adjacent end wall 16 and each adjacent side wall 18, respectively.

A center handle 26 projects from the top surface 22 of the base 14 and extends past the tops of the end walls 16. The center handle 26 spans the tray and has a grip portion 28. Preferably, the tray portion 12 and the center handle 26 are integrally molded.

In the preferred embodiment of the tray 10 of the present invention, the tray portion 12 is rectangular and has two parallel end walls 16 and two side walls 18 perpendicular to the end walls 16. The end walls 16 and the side walls 18 are preferably substantially perpendicular to the base wall 14 and have an inwardly offset rim 24 around the tray portion 12. The offset forms a shoulder surface 24A of the same thickness as the thickness of the cover. The integral connection between the end walls 16, the side walls 18, and the base wall 14 prevents leakage of any laboratory or medical samples, which could possibly spill or leak from vials in the tray.

A pedestal foot 30 projects from the bottom surface 20 of the base wall 14. The pedestal 30 preferably includes a leg 32 having a first end 34 and a second end 36. The first end 34 is attached to the bottom surface 20 of the base wall 14 whereby the leg 32 projects from the base wall 14 in the direction opposite the center handle 26. In addition, a pair of elongated support feet 38 are connected to the second end 36 of the leg 32 and extend laterally therefrom, whereby the tray 10 is supported on the pedestal 30. Preferably, the base wall 14 and the leg 32 are integrally molded.

A pair of hollow cover lids 40 having lower edges which surround the rim 24 of the tray portion end walls 16 and the side walls 18 when in closed position is illustrated in FIG. 1. Preferably, the cover lids 40 are formed from a transparent plastic such that a medical technician or laboratory assistant can view the vials through the cover lids 40 to determine whether any leakage or spillage had occurred before the cover lids 40 are opened. However, cover lids 40, which are translucent or opaque, are also within the scope of this invention.

Each cover lid 40 has a pair of end cover walls 42, a top cover wall 44 and a side cover wall 46. The cover lids 40 are each movably connected to the tray portion 12 by a pair of arms 48, each extending from one of the end cover walls 42 downwardly on the outside of the end walls 16 of the tray. The majority of the end cover walls 42 of the cover lids are wider than the end walls 16 of the tray so the cover lid can be moved to an open position. A tab 42A (FIG. 1) will rest on the shoulder 24A forming the rim 24, and the lower edge of side wall 46 also can rest on the shoulder.

A ramping mechanism 52 for permitting opening the cover lids 40 away from the top edge of the tray portion 12 is provided. The ramping mechanism 52 is disposed in the end walls 16 and pivotally and movably connects each arm 48 of the cover lids 40 to the end walls 16.

Preferably, the ramping mechanism 52 comprises a cam guide slot 54 formed in the end walls 16. The guide 54 is a shallow generally V-shaped cam guide with a low point 58 and guide ramps 58A and 58B extending laterally from the low point 58. The guide ramp section 58A is shorter than guide ramp section 58B. A separate cam guide follower pin 56 is connected to each arm 48 and is positioned in the guide slot 54 to permit pivoting and moving the cover lid 40 away from the rim 24.

The cover lids 40 are movable between closed and open positions as best illustrated in FIG. 2. When the cover lids 40 are in a closed position, the guide follower pin 56 rests in the low point or region 58 of the cam guide slot 54. As the cover lids 40 are moved to an open position, the guide follower 56 moves along the portion 58A of guide 54 toward the side wall 16, and also is pivoted about guide follower pin 56 as illustrated in dotted lines in FIG. 2. In this position, the cover lid 44 is partially open and has clearance with respect to the tray so it can be rotated further until the top cover wall 44 is substantially parallel to the side wall 18 of the tray 12 and the side cover wall 46 is substantially parallel to and below the base wall 14. Next, the cam guide follower pin 56 is slid back along the cam guide slot 54 past the low point 58 and along the guide portion 58B toward the center handle 26, as best illustrated in FIG. 2. In this position, the respective cover lid 40 is in an open position such that the top cover wall 44 substantially rests against the respective side wall 18. This position is shown in FIG. 3. In addition, the side cover wall 46 is positioned substantially between the bottom surface 20 and the top of the foot 38 on the respective side of the pedestal 30. The upward inclination of the respective cam guide portion 58 on each end wall 16 properly guides the cover into position so it will stay open until manually closed.

A pair of cover handles 60 can also be provided. Preferably, the cover handles 60 are integral to the cover lids 40 and extend the entire length of the tray 10. When the cover lids 40 are in a closed position, the cover lids 40 mate with the center handle 26 whereby medical or laboratory personnel, when carrying the tray, grasps the center handle 26 and the cover handles 60 together to securely restrain the cover lids 40 from leaving the closed position. In addition, each of the cover handles 60 preferably have a thickness less than the cover handle 26.

A rectangular resilient retainer pad 62 is positioned within the tray portion 12. The retainer pad 62 rests upon the top surface 22 of the base wall 14 and fits snugly between the end walls 16 and the side walls 18 of the tray portion 12. The pad 62 comprises a piece of shock absorbent material having at least one hole 64 (in practice, several holes are provided) extending therethrough for holding a standard medical or laboratory vial 66. The vials 66 are inserted in the holes 64 of the receptacle 62 and are frictionally held therein. Preferably, the vial 66 includes a cap to prevent spillage of the vial contents.

A gasket may be provided between the cover lid 40 and the tray portion 12 and resting on the rim 24 to substantially prevent any leakage from escaping between the cover lid 40 and the tray portion 12.

By providing a biological vial transport tray 10 according to the present invention, the cover lids can be closed to prevent the vials 66 from falling out of the tray portion 12 and being broken. In addition, the medical or laboratory samples, when the cover lids 40 are constructed of translucent or opaque material, are hidden from view thereby eliminating the unsightly nature associated with such samples.

Although the present invention has been described with reference to preferred embodiments, workers skilled in the art will recognize that changes may be made in form and detail without departing from the spirit and scope of the invention.

What is claimed is:

1. A biological vial transport tray comprising:

a tray portion having a base wall, a plurality of end walls and a plurality of side walls, the base wall having a bottom surface and a top surface, the end walls and side walls forming a rim around the tray portion;

a pedestal attached to the bottom surface of the base wall for supporting the tray portion on a supporting surface;

a pair of cover lids, each cover lid having a pair of end cover walls, a top cover wall, a side cover wall and a plurality of arms, the cover lids resting on the rim when the cover lids are in a closed position, and cam followers mounted on and extending downwardly from the end cover walls; and guide means connected to the end wall of the tray portion for receiving the cam followers guiding movement of the cover lid between an open position and the closed position.

2. The tray of claim 1 wherein the tray portion has a center handle integrally molded to the end walls of the tray portion and projecting above the rim of the tray portion and extending between the end walls.

3. The tray of claim 1 wherein the pedestal includes a leg having a first end portion and a second end portion, the first end portion being attached to the bottom surface of the base wall whereby the leg projects from the base wall in the direction opposite the center handle.

4. The tray of claim 3 whereby feet members are connected to the second end of the leg and are spaced from the bottom surface supported on the pedestal.

5. The tray of claim 1 wherein each cover lid includes a handle connected to the top cover.

6. The tray of claim 5 wherein the handle extends the entire length of the tray and mates with the center handle when the cover lids are in a closed position whereby medical or laboratory personnel, when carrying the tray, grasps the center handle and the cover handles together to securely restrain the cover lids from leaving the closed position.

7. The tray of claim 1 wherein the guide means comprises a cam guide slot recessed into the end walls of the tray portion.

8. The tray of claim 7 wherein the guide slot comprises an elongated slot extending in directions between the side walls and wherein the guide slot has a low region in the portion of the slot which is spaced a greater distance downwardly from the rim than of the guide.

9. The tray of claim 8 wherein the cam followers comprise arms on the end walls of each cover lid and a guide follower pin connected to each arm whereby the guide follower pin follows the guide slot and permits pivoting and moving the cover lid off the tray portion to move to an open position.

10. The tray of claim 9 wherein each cover lid pivots to an open position such that the top cover wall thereof substantially rests against the side wall of the tray portion.

11. The tray of claim 9 wherein the cover lid pivots to an open position such that the respective side cover wall is substantially positioned between the bottom surface of the base wall and a respective foot member of the pedestal.

12. The tray of claim 8 wherein the guide follower pin rests in the low region of the guide slot when the cover lid is in a closed position.

13. The tray of claim 1 and a retainer positioned within the tray portion such that the retainer rests upon the top surface of the base wall and between the end walls and the side walls.

14. The tray of claim 13 wherein the retainer comprises a block of shock absorbent material having at least one hole extending therethrough for receiving a specimen containing vial.

15. The tray of claim 1 wherein upper edges of the tray portion have a shoulder forming an inwardly offset rim, the cover lids surrounding the rim and overlying the shoulder in a closed position.

16. The tray of claim 1 wherein the cover lids are formed from a transparent material such that a medical technician or laboratory assistant can view the vials through the cover lids to determine whether any leakage or spillage had occurred before the cover lids are opened.

17. A biological vial transport tray comprising:

a tray portion having a base wall, a plurality of end walls and a plurality of side walls, the base wall having a bottom surface and a top surface, the end walls and side walls forming a rim around the tray portion;

a pedestal attached to the bottom surface of the base wall for supporting the tray portion on a supporting surface, the pedestal including a leg having a first end portion and a second end portion, the first end portion being attached to the bottom surface of the base wall whereby the leg projects from the base wall in the direction opposite the center handle;

a pair of cover lids, each cover lid having a pair of end cover walls, a top cover wall, a side cover wall and a plurality of arms, the cover lids resting on the rim when the cover lids are in a closed position, and cam followers mounted on and extending downwardly from the end cover walls; and guide means connected to the end wall of the tray portion for receiving the cam followers guiding movement of the cover lid between an open position and the closed position, the guide means comprising a cam guide slot recessed into the end walls of the tray portion, the cam guide slot comprising an elongated slot extending in directions between the side walls and wherein the guide slot has a low region in the portion of the slot which is spaced a greater distance downwardly from the rim than of the guide.

* * * * *